United States Patent [19]

Farmer et al.

[11] 3,978,751

[45] Sept. 7, 1976

[54] APPARATUS FOR CUTTING FIBROUS TOW INTO STAPLE

[76] Inventors: Earl T. Farmer, R.F.D. 3, Box 22B5A; Claude R. Keith, R.F.D. 2, Box 68-B, both of Gate City, Va. 24251; Garland B. Keith, 208 Forest Hills Drive, Kingsport, Tenn. 37663

[22] Filed: Oct. 9, 1974

[21] Appl. No.: 513,254

[52] U.S. Cl. ..... 83/403; 83/913

[51] Int. Cl.[2] ..... D01G 1/04

[58] Field of Search ..... 83/346, 7, 403, 418, 83/419, 420, 421, 443, 444, 913; 57/2

[56] References Cited

UNITED STATES PATENTS

| | | | |
|---|---|---|---|
| 2,296,298 | 9/1942 | Spalding et al. | 83/403 X |
| 2,703,172 | 3/1955 | Nash | 83/913 X |
| 2,765,035 | 10/1956 | Tucker | 83/403 X |
| 2,851,103 | 9/1958 | Anthony et al. | 83/403 X |
| 3,426,632 | 2/1969 | Ahles et al. | 83/913 X |
| 3,768,355 | 10/1973 | Farmer et al. | 83/403 |
| 3,861,257 | 1/1975 | Laird et al. | 83/913 X |

*Primary Examiner*—Othell M. Simpson
*Assistant Examiner*—Fred A. Silverberg

[57] ABSTRACT

This patent presents apparatus for cutting staple fibers to predetermined accurate lengths from yarn, tow or ropes. The apparatus includes a circular assembly incorporating a plurality of knives and one or more camming means which cooperate with the plurality of knives to pull a tow into cutting engagement with the knives in response to rotational movement of either the knife assembly or the camming means. A movable endless belt encircles the camming means and is adapted to move with the tow and, thereby, eliminate frictional heating generated between the tow/s and the camming surface/s. In one embodiment the endless belt is supported by a film of air, gas or liquid between it and the cam, and in an alternate embodiment the cam is a circular rotatable means and the endless belt is in direct contact therewith, but frictional heating is effectively eliminated because sliding engagement between the endless belt and the camming means is minimized. In additional embodiment both the camming means and the circular assembly of knives, being mounted concentrically, are rotated in the same or in different directions, thus causing twist to be imparted to the feed as well as to pull the tow into cutting engagement, providing means for separately varying each function over a broad range.

8 Claims, 17 Drawing Figures

APPARATUS FOR CUTTING FIBROUS TOW INTO STAPLE

BACKGROUND OF THE INVENTION

The problems encountered in cutting both crimped and uncrimped fibers in tow or ropelike feed are well known in the textile industry. Uniformity of length is particularly difficult to achieve in staple cut from crimped tows. Thus overlength staple is produced, resulting in extreme difficulty in subsequent processing in the drawing machinery.

Fusing of ends is an additional problem on all cutters, particularly where impact of the blades and the cutting force combine to produce local heat which is near the melting point of the material being processed. Wetting down of the tow or rope is employed in many instances to dissipate heat of fusion, but it is an unsatisfactory alternative since it necessitates subsequent drying, hence expensive and unnecessary equipment and added cost to the product. Even wet end usage results in inflated handling, packaging and transportation costs.

Feed is also a problem in most cutters, particularly those of the knife and anvil and Beria types. Vacuum is in common use to direct the tow band from the final feed rollers to the knife, anvil pinch point. While this method produces staple, two problems are inherent in its use: folds or length variation irregularities in the tow are immediately stretched out by the suction, thus producing long ends. Also, equipment must be supplied both to produce the vacuum and to separate cut staple from the air stream at some point downstream from the cutter. The separation problem is particularly troublesome on short flock-like staple. While vacuum is not in common use on the Beria type cutters, centrifugal force stretches out the irregularities in the tow band and produces the selfsame objectionable long ends.

An apparatus overcoming the aforementioned difficulties has been proposed by this inventor and is the subject of an U.S. Pat. No. 3,768,355 entitled "Method and Apparatus for Cutting Fibrous Tow into Staple." This apparatus involves a power operated rotatable hollow shaft, having an inlet and an outlet passage for tow or rope. Adjacent to the outlet passage is a frame having a plurality of knives radially positioned with their sharp edges closely adjacent to the outlet passage. Movement of the tow or rope through the passageway impinges the outer side of the tow or rope against the sharp edges to cut the tow or rope in fibers of generally very uniform length. The knives are mounted to be adjustable with respect to the outlet passage whereby to continuously present a sharp portion of the knife edge for cutting purposes.

This latest improvement to the art of cutting tow or rope does not completely meet the demands of the industry in that the apparatus has somewhat limited production capabilities since, particularly at higher rates of throughput, the apparatus involved generation of excessive heat created by the frictional sliding contact of the tow on the cam surfaces.

An object of the instant invention is to provide a satisfactory resolution to the aforestated problems.

Another object of the instant invention is to provide a means to simultaneously feed a plurality of tows to a cam operated rotary staple cutter.

A further object of the invention is to provide a means whereby frictional heating generated between the tow and the cam surfaces is eliminated.

It is a further object of the present invention to provide a cooling means for the machinery which utilizes a liquid which may be mixed with the cut staple to provide a desired end product, complete with required finish.

It is a still further object of the present invention to provide a tow cutting apparatus which is relatively inexpensive to produce and operate and is relatively maintenance free and provides consistent uniform results.

An additional object of the present invention is to provide a tow cutting apparatus which will impart any desired magnitude of twist to the tow feed, regardless of inlet feed speed, thereby making it possible to satisfactorily cut a variety of fibrous materials considered to be unprocessable previously.

SUMMARY OF THE INVENTION

The aforestated objectives of this invention are accomplished by providing a tow cutting device which incorporates a plurality of knives assembled in a ring which may be rotated or held stationary. The knives cooperate with a cam means which in the case of the stationary knife assembly is held stationary, or in the case of necessary twist in the feed, both knife assembly and camming means are rotated, in same or opposite directions.

A plurality of cam surfaces are provided to accommodate a plurality of tows to enable simultaneous cutting by a single knife assembly.

An endless belt is provided between the cam surfaces and the tow to eliminate frictional engagement between the cam surfaces and the tow by adapting the endless belt to move with the tow. Therefore, frictional engagement between sliding members occurs between the belt and the cam surface. The sliding engagement is eliminated by providing an air, gas or liquid bearing between the cam surface and the belt in one instance, by providing a rotating circular cam surface in a second instance, and by providing both means in a third instance.

DESCRIPTION OF THE PREFERRED EMBODIMENTS

Figure 1:
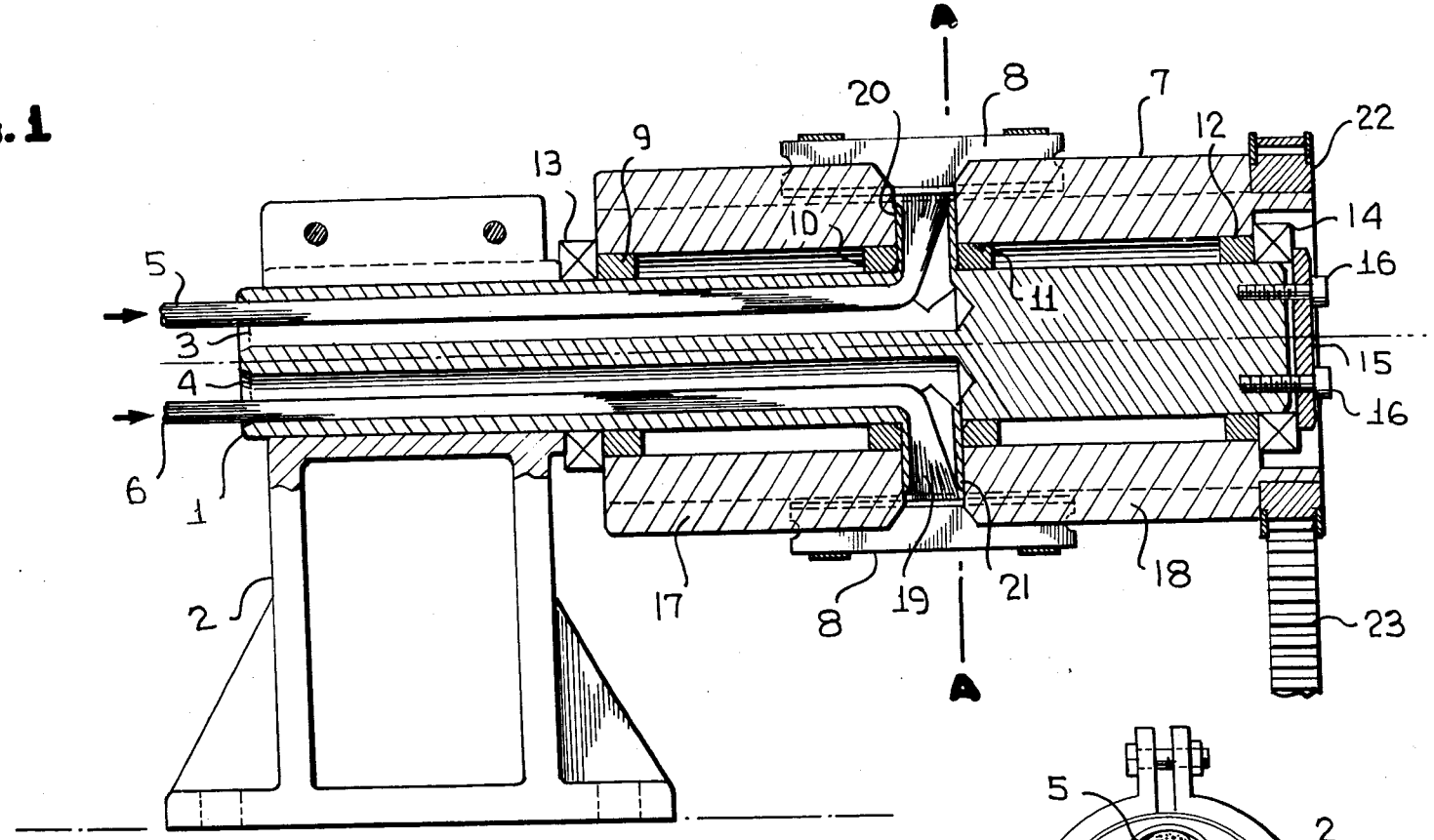
FIG. 1 is a cut-away view of one embodiment of the present apparatus for cutting a plurality of fibrous tows into staple fibers.

FIG. 1 is a cut-away view of a preferred embodiment of the invention. It illustrates an apparatus capable of simultaneously cutting a plurality of tows into staple. To simplify the explanation only two tows are illustrated, however the actual number of tows that may be processed by the invention is limited only by the user's requirements and the physical size of the apparatus.

The embodiment illustrated in FIG. 1 incorporates a stationary shaft 1, secured in a mounting frame 2. The shaft incorporates a plurality of bores 3, 4, each adapted to receive individual tows 5, 6. A rotatable knife assembly 7, housing a plurality of knives 8, is supported by bearings 9, 10, 11, 12 and positioned at one end of the shaft 1, by a pair of thrust bearings 13, 14. A removable retaining cap 15, is secured to one end of the shaft 1, by a plurality of cap screws 16, to enable easy fit-up of the knife assembly 7, for optimum running clearances. A like cap may be installed on the opposite end of the shaft for similar adjustment purposes.

The knife assembly incorporates two journal members 17, 18, which are rigidly interconnected by the plurality of knives 8, and adapt to provide a space 19, there-between to accommodate the two cams 20, 21. A drive pulley 22, is rigidly affixed to one end of journal member 18 and is driven by a conventional power source through drive belt 23.

In operation, the tows 5, 6, are pulled through the bores 3, 4, and over the cams 20, 21, by the rotational action of the knives 8, which cooperate with the cams 20, 21, to both pull the tow through the bores 3, 4 and subsequently squeezes the pack of fiber against the knife edges to sever the tows 5, 6, into staple.

Figure 2:
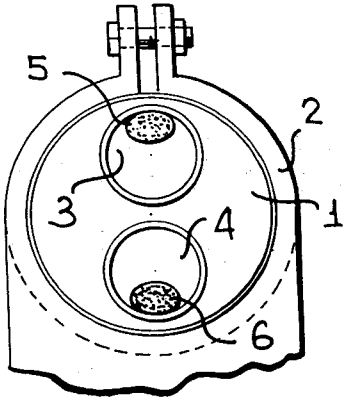
FIG. 2 is an end view illustrating the tow guide means of the embodiment illustrated in FIG. 1.

FIG. 2 is an end view of the above preferred embodiment which illustrates how these tows are fed into the end of the stationary shaft. Three, four, or any number of tows can be accommodated by providing additional bores in the shaft, the number being limited only by the shaft size and the number of tow bands which can be physically fed therein.

Figure 3:
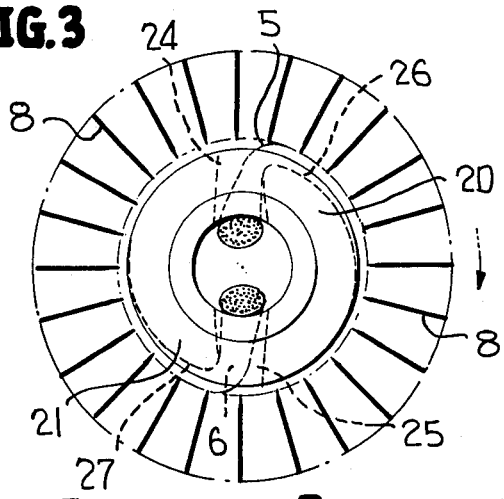
FIG. 3 is a sectional view along the line A—A of the embodiment presented by FIG. 1 which illustrates the cam and knife assembly interaction.

FIG. 3 is a sectional view taken along the line A—A of FIG. 1. In this illustration it can be seen that the cams 20, 21, incorporate deflection channels 24, 25, for each tow and cam surfaces 26, 27, which cooperate with the knives 8, to pull the tow through the deflecting chamber. Note that the surface of the cam cooperates with the knives 8, such that the knives initially cut into a portion of the tow, pulling the tow out and around and subsequently severing it.

In this preferred embodiment, the rotational action of the knives 8, assisted by the cams 20, 21, create a centrifugal force which causes the severed staple to be thrown out and into a conveying means or collection bin.

Figure 4:
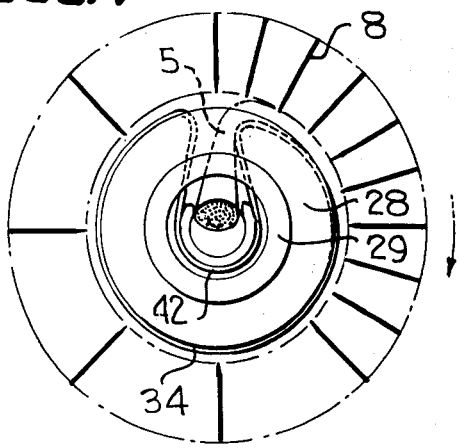
FIG. 4 is a sectional view along the line A—A of FIG. 1 illustrating the cam and knife interaction for an apparatus configured to process a single tow, incorporating an endless belt as a carrier to eliminate frictional heat buildup in the tow.

FIG. 4 illustrates a cam 28 and knife arrangement adapted to process a single tow. In this embodiment the knives 8, may be held stationary and the cam 28 and associated shaft 29, may be rotated. The pulling action of the tow is the same in this embodiment as in the previous embodiment, because it functions on the relative movement between the cam surface and the knives. In this embodiment, the cam 28, is rotating and only one tow may be inserted in an end of the shaft, otherwise the tows would become twisted and jam the machine. However, a second tow can be fed from the opposite end without this difficulty. The endless belt 34, and shaft extension guide shoe 42, evident in this view, are discussed in FIGS. 5 and 6.

Figure 5:
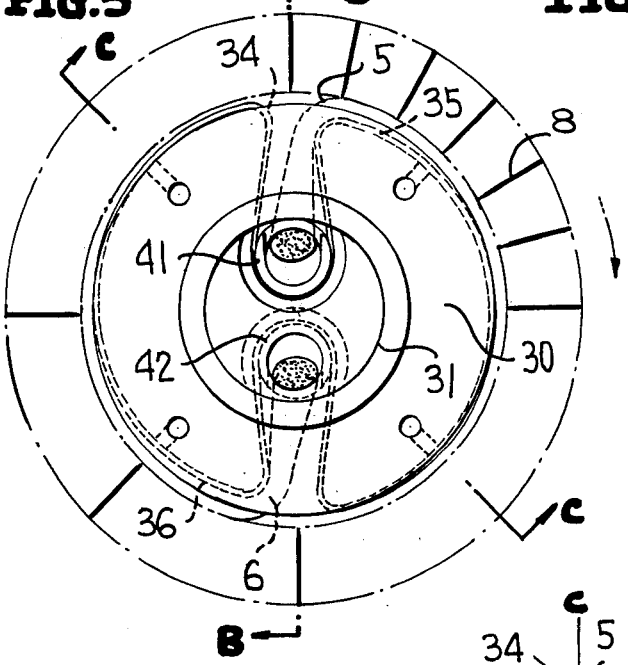
FIG. 5 is a sectional view along the line A—A of FIG. 1 illustrating the cam and knife assembly of an embodiment of the instant invention configured to process two tows fed from either the same end or from opposite ends of the assembly, incorporating the endless belt to eliminate frictional heat in both tows.

FIG. 5 illustrates a cam assembly 30 which may be used to form an additional embodiment of the apparatus. In this embodiment the knives 8, may be held stationary and the shaft 31 rotated, or the shaft 31, held stationary and the knives 8, rotated. In the illustration, the shaft 31, is rotated and the knives held stationary, but two tows are processed. This is accomplished by feeding tows into the cam assembly 30, from opposite ends, as mentioned previously.

Figure 6:
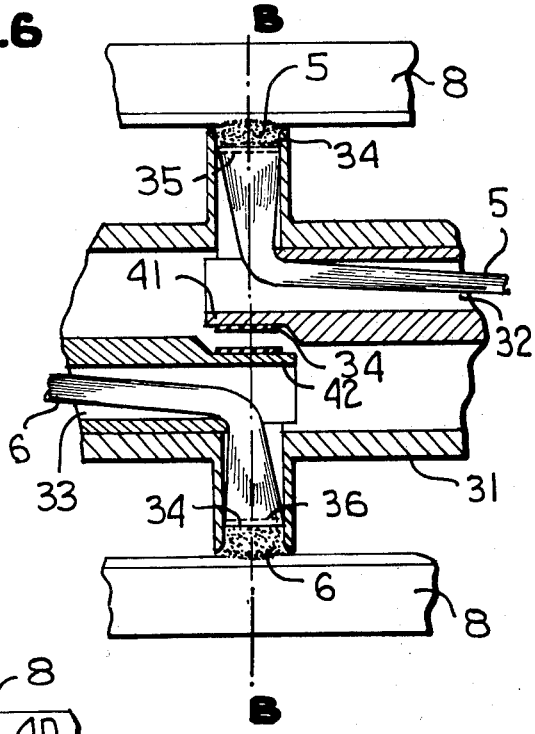
FIG. 6 is a top cut-away view taken along line B—B of FIG. 5, illustrating the tow guide configuration incorporated by the assembly illustrated in FIG. 5, with tow fed in from opposite ends.

This concept is illustrated in FIG. 6, which depicts a shaft 31, having bores 32, 33, which allow a tow to be inserted from either end of the shaft 31. In this embodiment, if the shaft is rotated, the machine can accommodate two tows. However, an alternate embodiment, wherein the shaft is held stationary as previously described and the knife assembly rotated about the shaft and cam assembly, would allow a plurality of tows to be fed into the device from both ends of the shaft.

Figure 7:
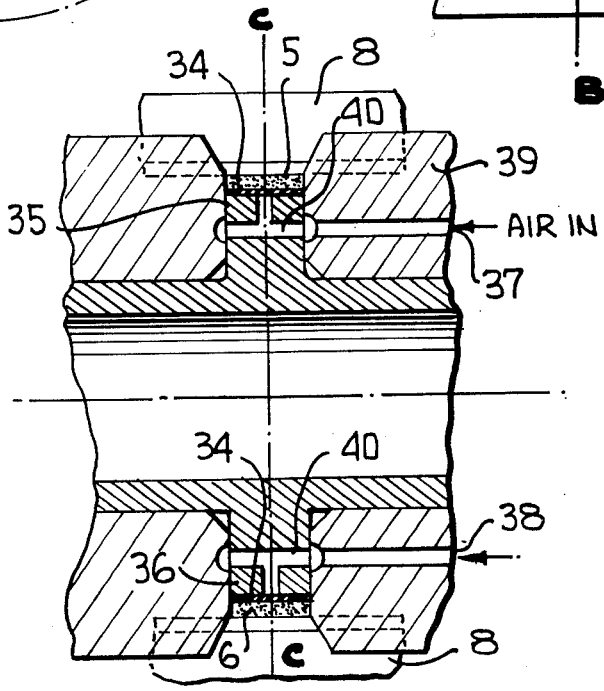
FIG. 7 is a cut-away view taken along line C—C of FIG. 5, illustrating the air bearing manifold incorporated by the invention to levitate the endless belt which supports the tow.

FIGS. 5 and 6 illustrate a frictional heat reducing embodiment that may be incorporated in all of the other embodiments of the apparatus. This device is comprised of a belt 34, which is free to rotate between the cam surfaces 35, 36 and the tows 5, 6. The belt 34, is preferably comprised of a heat resistant, frictionless material and rotates with the tow, thus eliminating frictional heating between the tow and the belt 34. Frictional heating between the belt 34 and the cams 35, 36, is reduced or eliminated by providing an air bearing surface between the cams 35, 36 and the belt 34. This concept is illustrated in FIG. 7 which shows air input ports 37, 38, provided in the knife assembly journal 39, which feed cooling and lubricating air to a manifold network 40, within the structure of the cam assembly 30. If desired, air can be replaced by a lubricating fluid, which can be allowed to mingle with the cut staple. Therefore, if it is desired that the staple be mixed with a finishing solution, that solution may be introduced through the cooling and lubricating manifold, where it will support the belt 34 and flow into the knife assembly with the staple and be cast into the collecting bin by centrifugal action of either the knife assembly, or the shaft assembly, depending on which is rotating. Obviously, a mixture of air and finishing solution in any desired ratio may be used, employing the air pressure to distribute the solution evenly through the cut fiber.

Referring to FIG. 5, it can be seen that the endless belt 34, passes about the cam surface, thus supporting the tow. It also passes about the extensions of the shafts 41, 42, which form the exit orifices of the bores 32, 33. Thus the only frictional engagement between the tow and the apparatus is along the bores 32, 33 and it is minimal and will not produce heat of significant magnitude. If the belt 34, is not incorported, excessive frictional heat may develop between the cam surfaces and the tow if the machine is run at a relatively high rate of speed. In this case, cooling fluid may be circulated through a closed manifold system within the cam assembly and shaft, much in the manner of manifold 40, except that orifices to the cam surface are eliminated.

Figure 8:
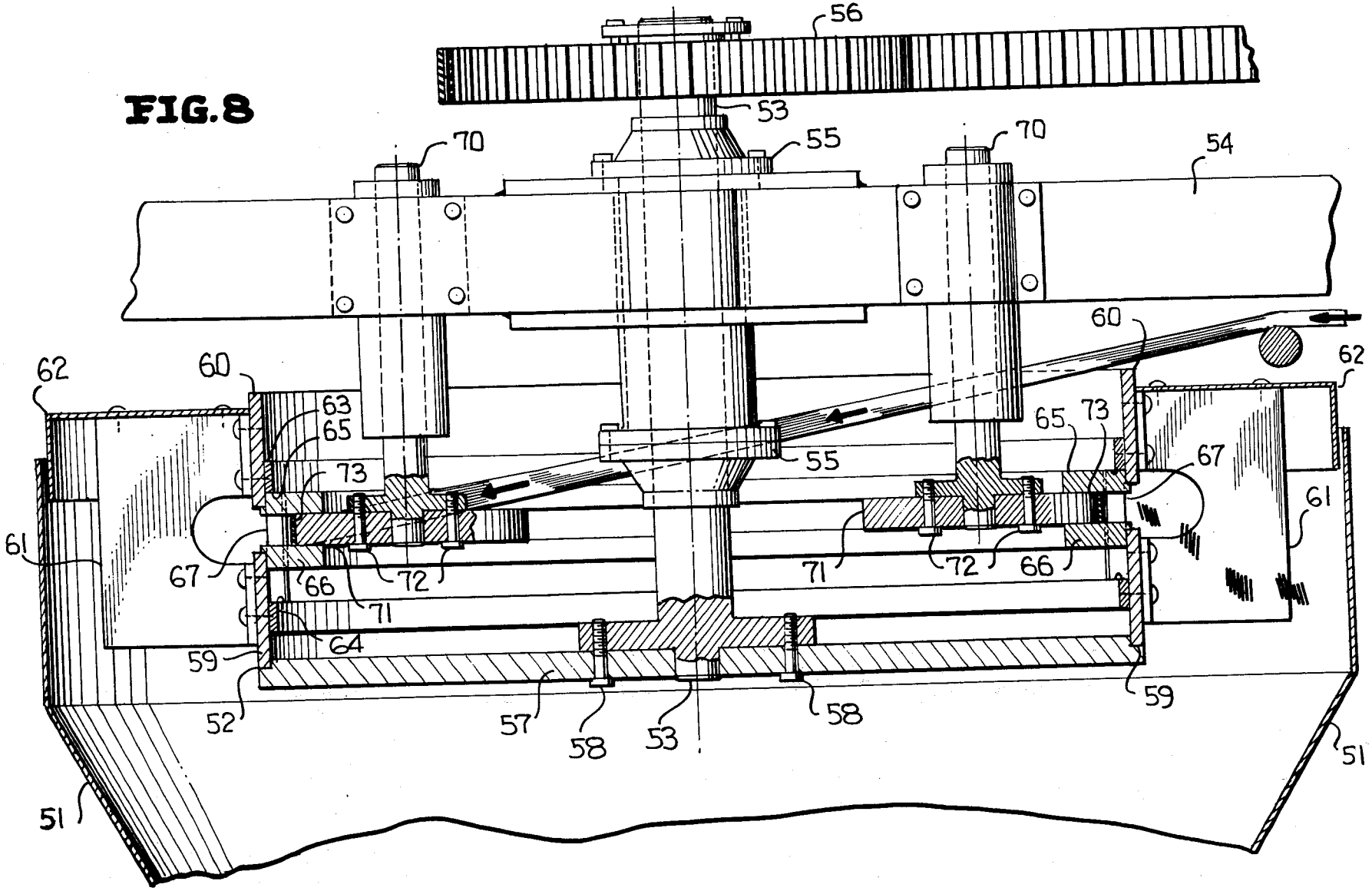
FIG. 8 is a side view partially cut away, illustrating an alternate embodiment of the invention.

FIG. 8 is a preferred embodiment for large scale production of staple. In this embodiment the device is configured to rotate about a vertical axis and a collector shield 51, encompasses the lower portion of the machine and functions to channel the staple into a collecting hopper.

As can be seen in FIG. 8, a rotating knife assembly 52, is secured to a rotating shaft 53, which is supported by a frame assembly 54. The frame assembly incorporates a support bearing means 55, in its center through which the shaft passes. The portion of the shaft which extends above the frame assembly 54, incorporates a pulley 56, or other means, which may cooperate with a belt, or chain, to provide rotational driving force to the shaft. If desired, a motor may be coupled directly to the shaft.

A driving disc assembly 57, is securely fastened to the lower end of the rotating shaft 53, by screw means 58. A lower support ring 59, is affixed to the periphery of the driving disc 57, such that it rotates in response to rotational movement of the main shaft 53. An upper support ring 60, is securely affixed to the lower support 59, by a plurality of support ring brackets 61, which provide an additional function of supporting a staple deflector 62. Upper 63, and lower 64, knife adjusting rings are affixed to the upper and lower support rings and positionally secure the upper 65, and lower 66, knife retaining rings. The upper 65 and lower 66, knife retaining rings incorporate slots which are adapted to hold the knife blades 67.

A plurality of cam assemblies are supported by shafts 70, which are affixed to the frame assembly 54. The cam assemblies 70, incorporate cam members 71, which are securely fastened to the lower end of the cam supporting shaft 70, by a plurality of screws 72. An endless belt 73, is provided over the cam surfaces, as previously described, to provide a frictionless means for carrying the tow into cutting relationship with the knives.

Figures 9, 10:
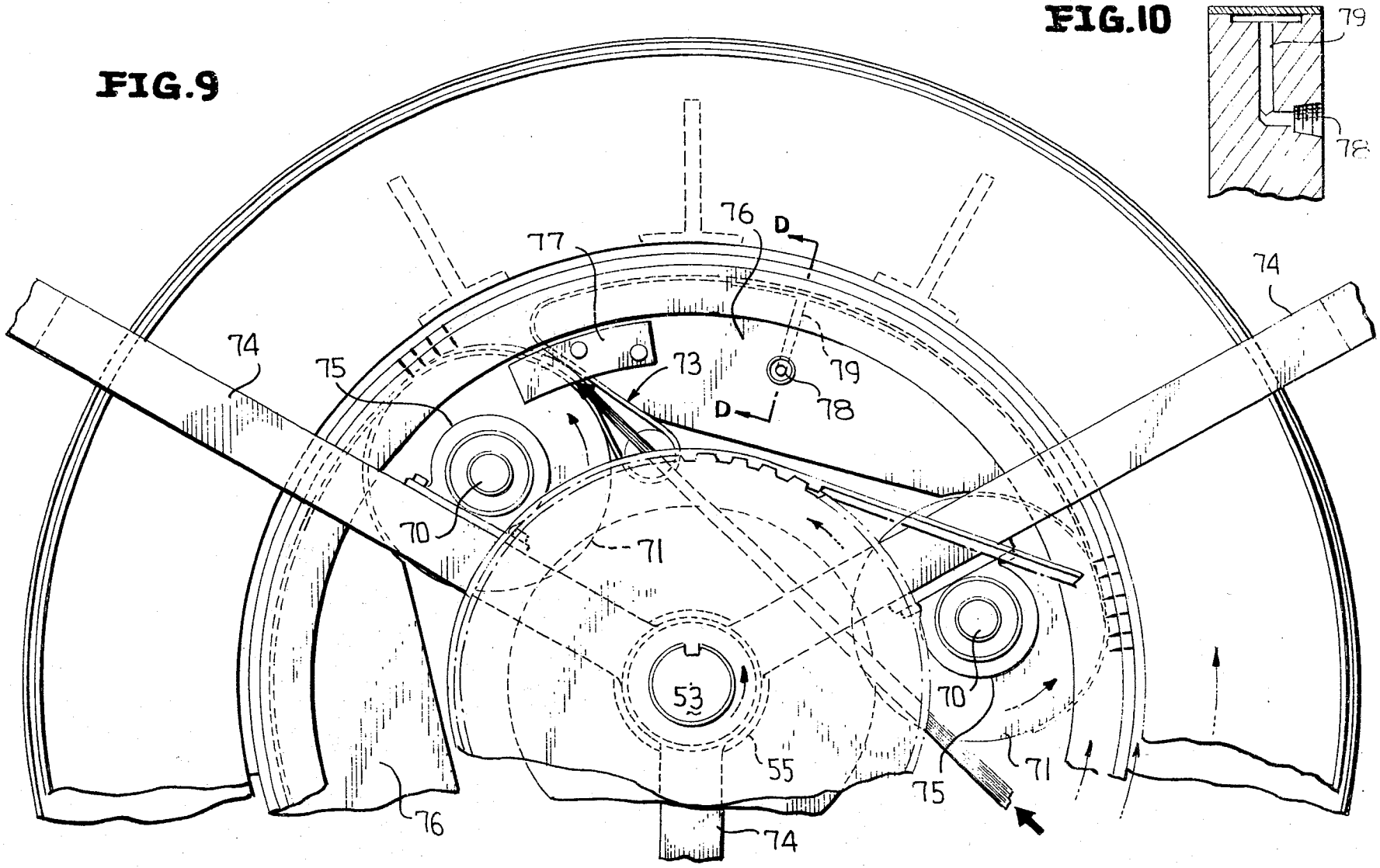
FIG. 9 is a top partial view of the embodiment of the invention depicted in FIG. 8.
FIG. 10 is a cut-away view of the air bearing manifold incorporated by the subject invention, taken along line D—D.

FIG. 9 is an upper view of this embodiment which illustrates the frame, incorporating three radial members 74. The main support shaft 53, passes through a support bearing 55, positioned in the center of the frame and each frame member supports an individual cam assembly. Each cam assembly may incorporate a single endless belt supported by a film of air or liquid as previously described, or a single belt may be incorporated which encompasses all of the cam assemblies in the machine. If this latter embodiment is incorporated, additional support means 76, is provided between adjacent cam assemblies and tow guide means 77, is provided for each tow.

It should be noted that the cams 71, are circular, and free to rotate with the belt means 73. To this end, the cam supporting shaft is connected to the supporting frame by way of a bearing 75, providing alternate driving means.

Belt support means 76, positioned between the cam assemblies, is secured to radial members 74, by suitable brackets not shown. Air inlet holes 78 and 79, are provided in the belt guide means 76, to allow air or other media to levitate belt 73, as previously described. The tow guide 77, is rigidly secured to the belt guide 76, to insure that the tow enters the knife and cam interface at the proper angle.

FIG. 10 is a cut-a-way view of belt support means 76, along line D—D disclosing the fluid manifold holes 78, 79, for supplying air or liquid to levitate the belt.

Figure 11:
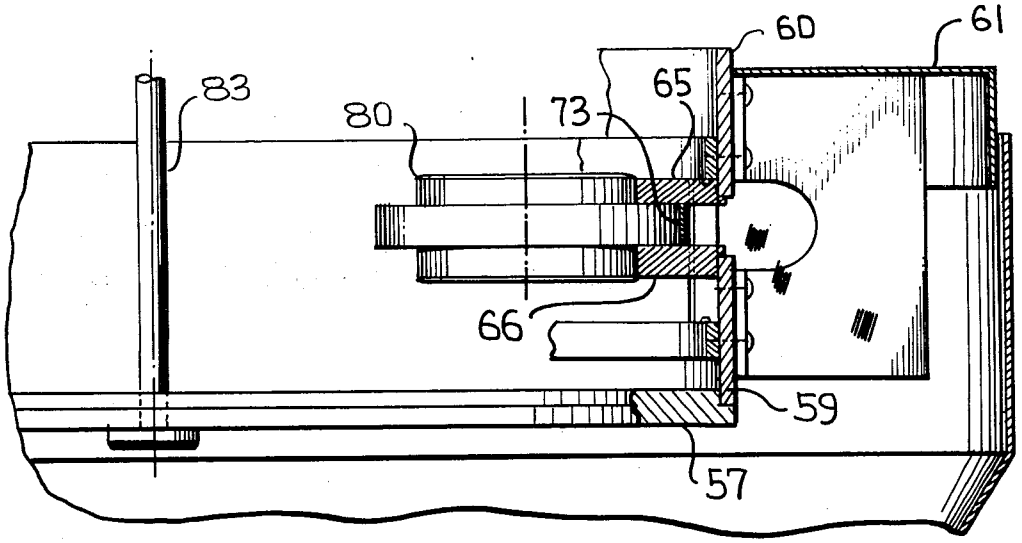
FIG. 11 is a partial view illustrating the cam assembly and knife assembly for an alternate embodiment of the apparatus described in FIG. 8.

FIG. 11 is a more detailed view of the rotating assembly. In this view the rotating disc 57, can more clearly be seen and its function of supporting the lower support ring 59 and upper support ring 60, via the ring support bracket 61, is obvious. This figure illustrates the use of a stepped roller 80, which is adapted to guide the belt 73, into a tow channel formed by the upper 65, and lower 66, knife retaining rings. The narrow center shaft 83, merely supports the weight of the assembly and is not a driving means.

Figure 12:
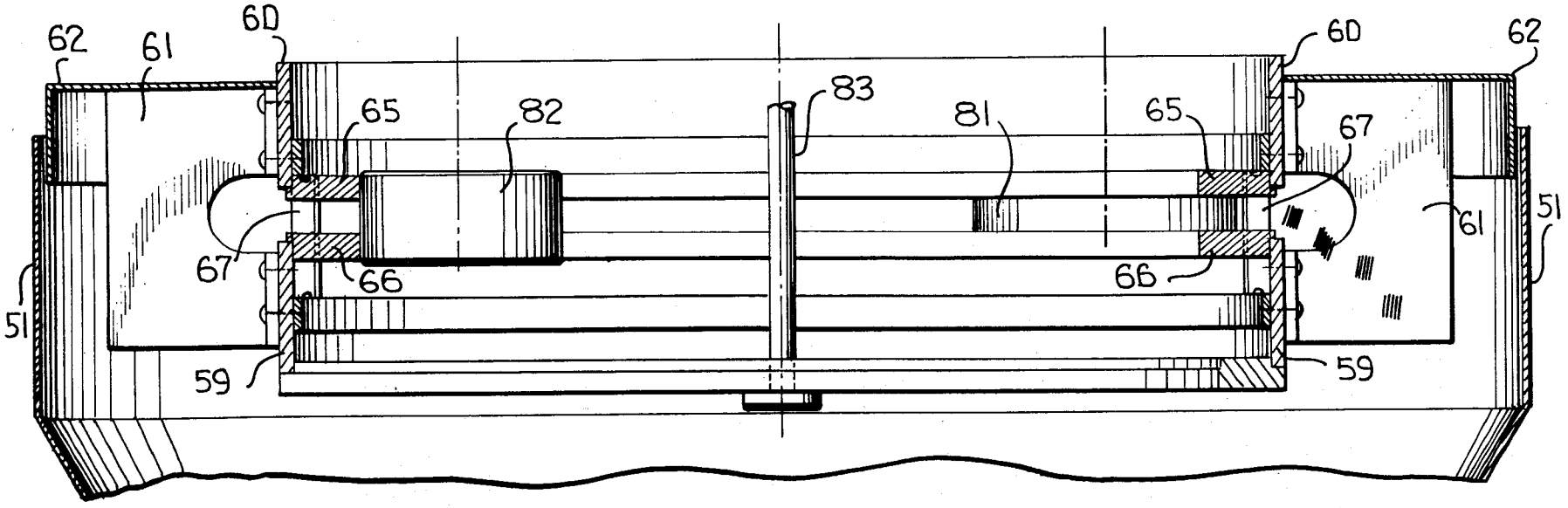
FIG. 12 is a cut-away view depicting another alternate embodiment of the cam and knife interaction, employing guide rollers to insure concentricity of assemblies.

FIG. 12 illustrates an aleternate embodiment wherein a fiber feed roller 81, is utilized in place of a stepped roller. In this embodiment, a plurality of rotating assembly centering rollers 82, are provided to cooperate with the upper and lower knife support rings 65, 66 and maintain the rotating assembly in a stable condition. The fiber feed rollers 81, are adapted such that their outer edges fit within the channel formed by the upper 65 and lower 66, knife retaining rings which act as a means to guide the tow into the knives 67, while positioning the rotating assembly vertically. Center shaft 83, supports the weight of the assembly to achieve a vertical weight balance, thereby avoiding needless friction and wear between feed rollers 81 and knife support rings 65 and 66.

Figure 13:
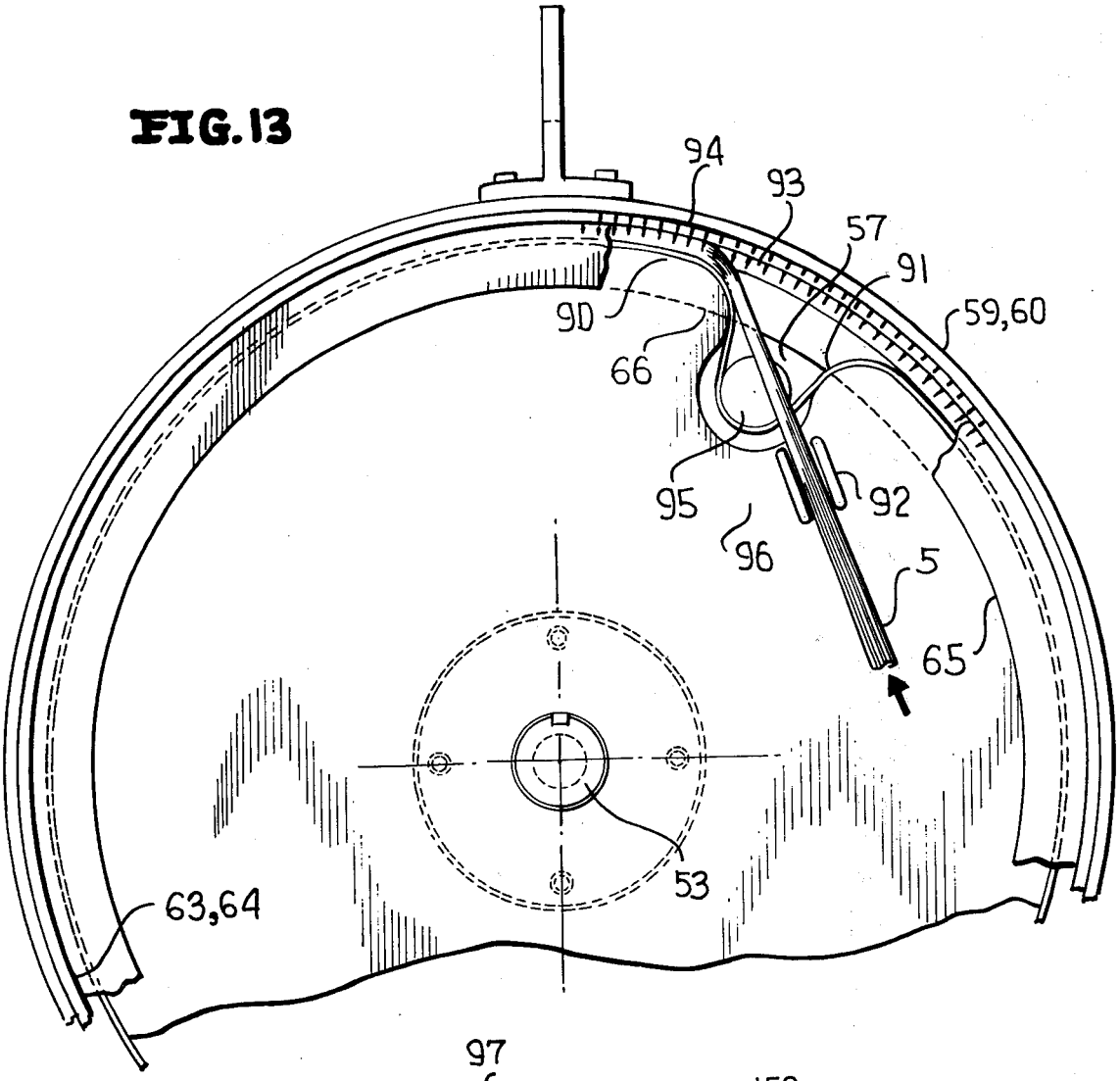
FIG. 13 is a partial top view of another alternate embodiment of the invention for processing a plurality of tows simultaneously.

FIG. 13 illustrates a cam assembly for another alternate embodiment of the device which is capable of handling a large number of tows. To simplify the illustration, however, only one tow is shown.

In this embodiment, the cam assembly 90, is stationary and an endless belt 91, moves about the cam surface with a tow 5, as previously described. To eliminate the bulk of a large shaft incorporating a plurality of bores, as suggested by an earlier embodiment, tow feed is accomplished by guides 92, which channel the tow to the knife assembly 93 and endless belt 91, which cooperate with the cam 90, to pull the tow over the guide 92 and through the cutting mechanism. A belt guide 95, is provided for each tow to cause the belt to be displaced sufficiently to allow the tow to enter between the belt and the knives. Said belt guide is adjustable to set optimum tension on belt 91, for all operating conditions.

Pressurized air may be provided to the surfaces of the belt guide in a manner similar to that suggested for the cam surfaces with respect to earlier embodiments.

The knife assembly 93, illustrated in FIG. 13, contains a plurality of knives 94, which are supported by knife retaining rings 65 and 66 and support rings 59 and 60, which are caused to rotate about the cam assembly 90, in a manner similar to that previously described for the first preferred embodiment.

In FIG. 13 the tow guide 92, is mounted on a stationary plate 96, in the middle of the assembly. The tow passes from the tow carrying means, or tow guide 92, onto the belt 91 and is forced into contact with a knife as previously described. The knife cuts the tow and the centrifugal force flings the cut tow outward into the collecting bin or hopper. The means for holding the knives 94, in this embodiment is a plurality of slots provided in the knife holding rings 65 and 66. The upper 63 and lower 64, rings provide a means to adjust the knives 94.

In this embodiment the driving means is through the center drive shaft 53 and through a disc 57, which extends to the outer rotating assembly, in a manner similar to driving disc 57, of FIG. 8.

Figure 14:
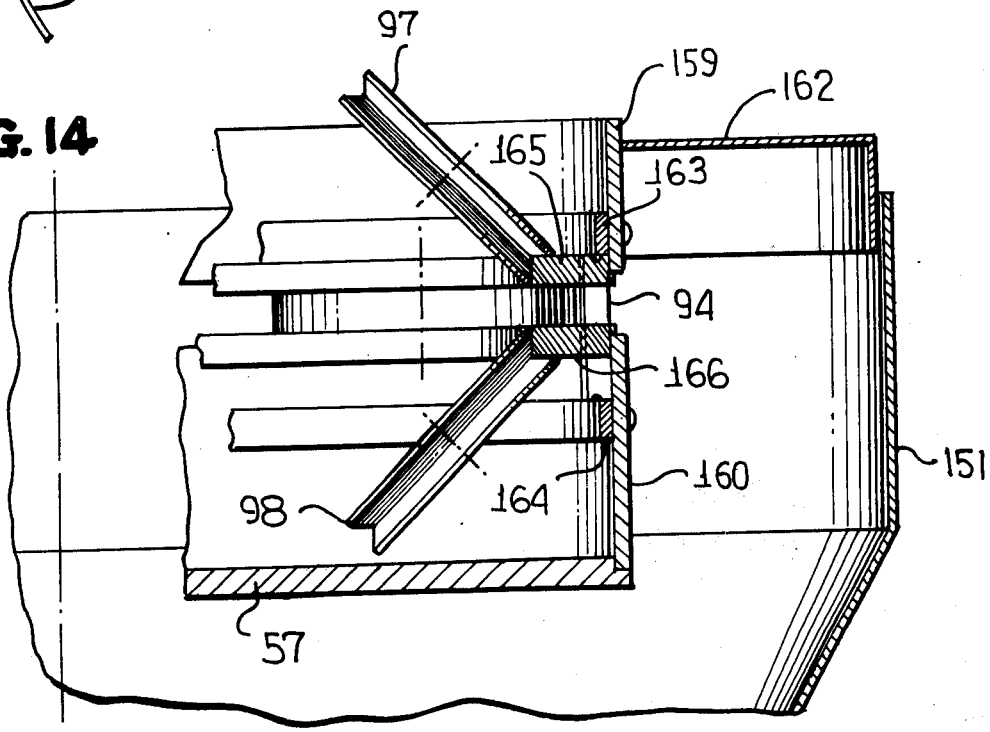
FIG. 14 is a detailed view of the knife assembly supporting means incorporated by one embodiment of the invention, employing grooved guide rollers to insure axial alignment clearances for assemblies.

FIG. 14 illustrates an additional embodiment of the invention wherein the rotating knife assembly may be supported by a different means other than the center shaft and driving disc. Note that the knife retaining rings 165 and 166, supporting the knife blades are supported by grooved upper 97 and lower 98, canted rollers. The knife retaining rings 165 and 166, are attached to the upper and lower rotating support rings 159 and 160. Knife spacer rings 163 and 164, position knives 94, so as to prevent their movement in the slots of knife retaining rings 165 and 166.

FIG. 14 also illustrates a cut staple shield 162, which is affixed to the upper rotating ring 160. This shield rotates within the collector hopper 151 and the shield and hopper cooperate to channel the cut staple into a collecting bin.

At least three sets of canted rollers 97 and 98, are provided to support the rotating assembly. They cause the assembly to rotate around an imaginary center and hold the assembly horizontally and vertically stable. The lower roller 98, supports and bears on the inner periphery and under side of the lower knife retaining ring 166, thereby preventing the outer rotating assembly from moving downward or inward. The upper roller 97, bears on the top and inner periphery of the upper knife retaining ring 165 and prevents it from moving upward or inward.

The driving means for this embodiment is through a rotating center shaft as previously described, or it can be accomplished by applying a belt to the upper support ring 159, in the approximate location where the shield 162, attaches. If this latter driving concept is incorporated, the assembly is similar to that described for the first preferred embodiment.

Figure 15:
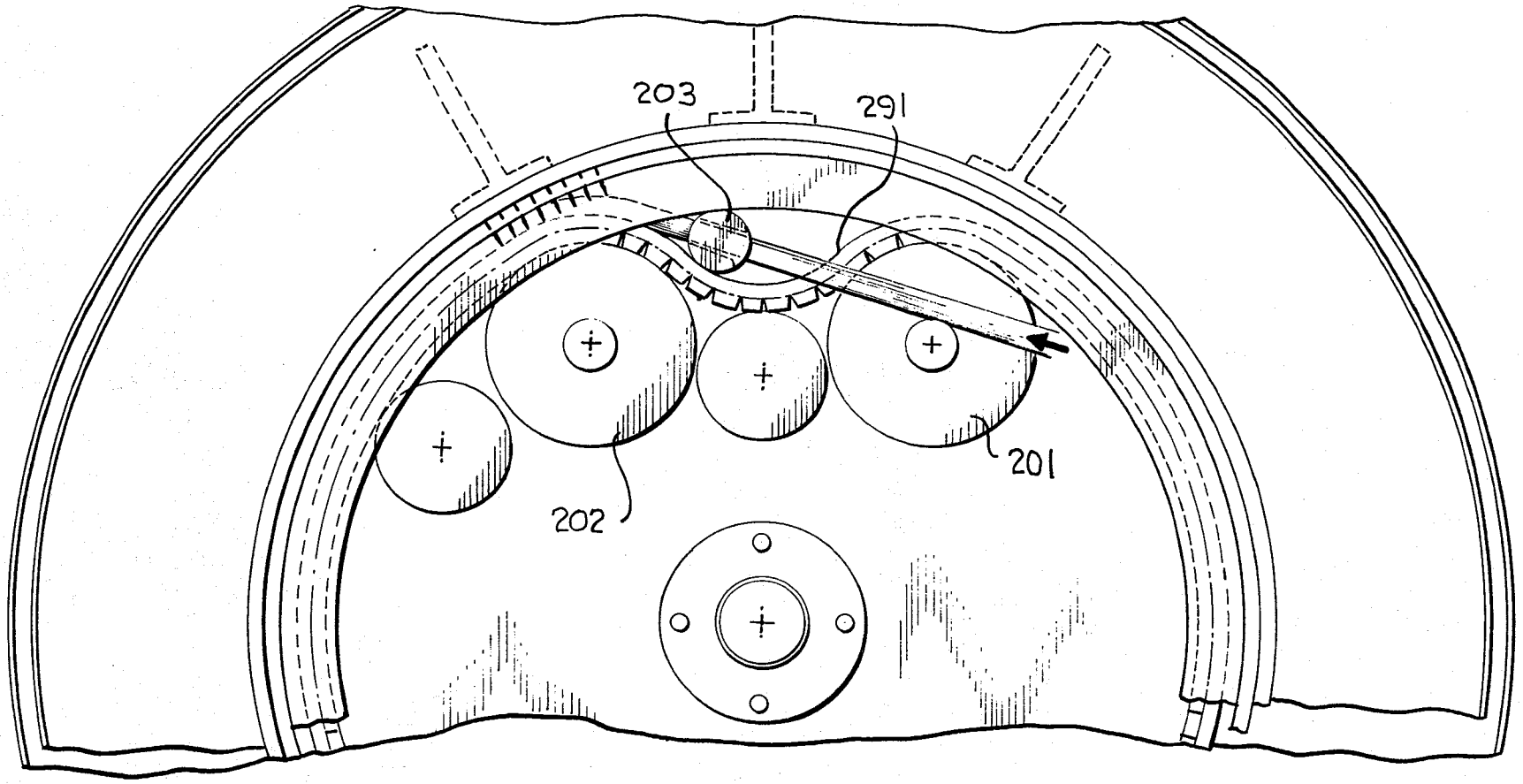
FIG. 15 is a partial top view of an embodiment of the instant invention incorporating a relatively thick endless belt, notched for flexibility, and employing rollers to carry said belt and tow, thus avoiding frictional heat.

FIG. 15 illustrates an embodiment wherein the endless belt used to carry the tow is a relatively thick member. In this embodiment the belt 291, performs the same function as in prior embodiments, that is, it acts as a friction reducing member between the tow and the cam surfaces. It follows the tow as it travels through the channel and around with the rotating knife assembly. The belt is a compressional member and its width very closely fits the tow containing channel. It holds the tow in position while it is being cut and recirculates the uncut tow around the rotating knife assembly such that additional tow is piled on top of the uncut portion of the tow. In this event the added incoming feed layer increases the pressure on the tow and additional staple is cut.

The belt member may be a thin, easily bent strip of metal similar to a band saw blade, or it may be a wound section of wire, such as high strength piano wire, wound in many turns between the inner and outer sections. These sections may be glued together to contain the wire, so as not to permit its escape from the tow channel in the rotating knife assembly. The belt may be a hollow assembly. In this case it may be inflated through a small air valve, similar to a football or basketball. Various other constructions are obvious and a number of them may be employed as satisfactorily as those described.

As illustrated in the preceding embodiments, there must be a small loop in the belt so that it may emerge from the tow containing channel sufficient to permit tow to be fed into the tow channel. At this point either a shoe or a roller can be used to guide the belt. Obvious variations indicate that either two shoes, or two rollers, or a roller and a shoe may be used. In the event that two rollers are used, as illustrated in FIG. 15, one roller 201, permits the belt to escape from the tow containing channel and the other roller 202, gently pushes it back into the tow containing channel, after the tow has had opportunity to be inserted via the tow guide 203. The use of rollers eliminates the need for the levitating effect described previously with respect to a frictionless means for supporting the belt. However, a serpentine edged stationary plate, similar to that employed in FIG. 13, may be used here and the heavy belt levitated as described previously, with air.

Figure 16:
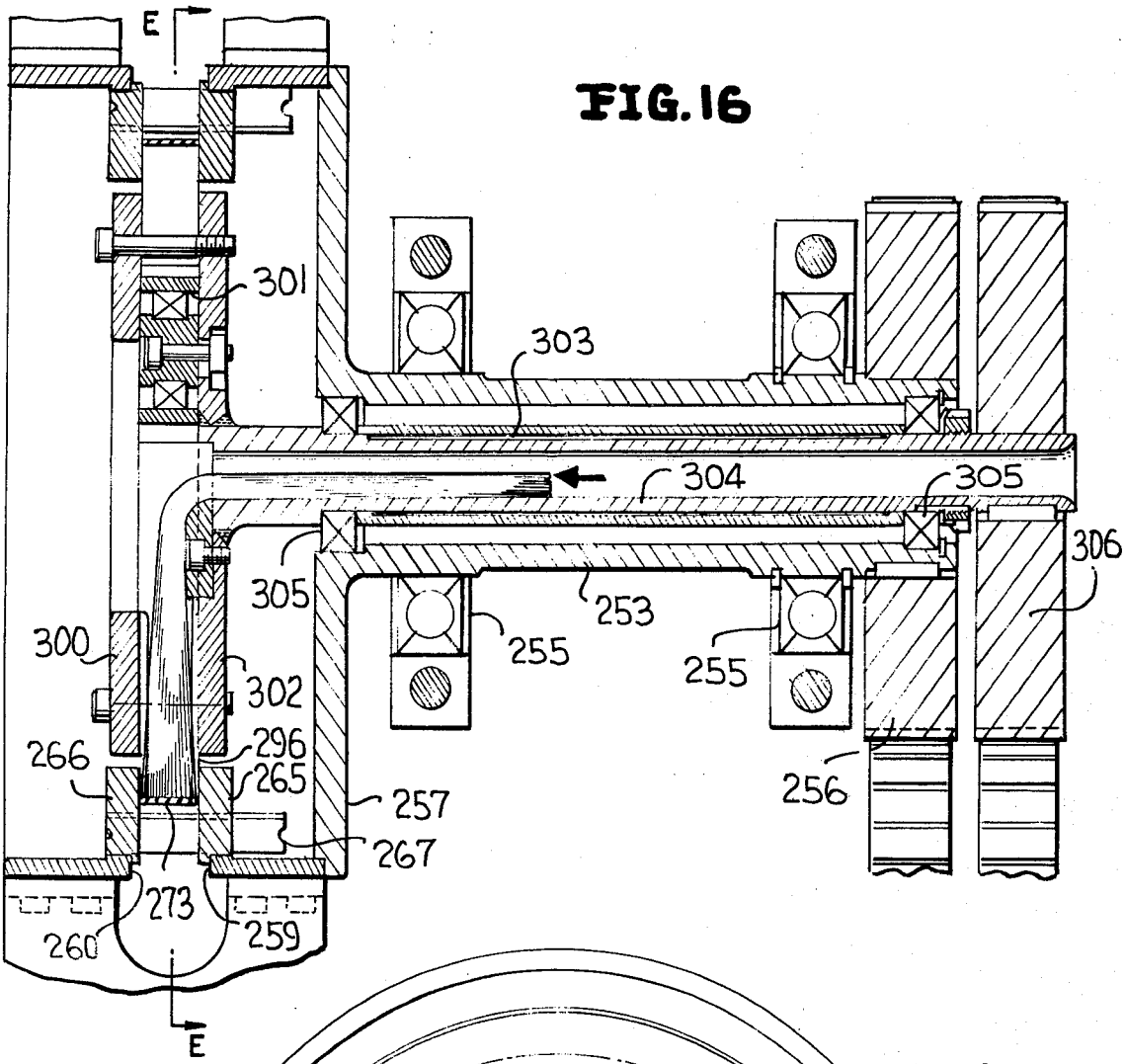
FIG. 16 is a top sectional view of an embodiment of the instant invention showing the knife assembly supporting means and the camming means in rotatable concentricity with variable driving means on each, suitable for processing two tows simultaneously.

FIG. 16 illustrates a further embodiment of the invention wherein both the knife assembly and the camming assembly are rotatably mounted with somewhat startling results.

In the illustrated assembly, FIG. 16, the knife assembly composed of support rings 259, 260, knife retaining rings 265, 266, knives 267, driving disc 257 and hollow shaft 253, is rotatably mounted in bearings 255. It is rotatably driven through drive pulley 256, by variable driving means, not shown. Additionally, camming assembly composed of cam plate 296, levitated endless belt 273, clamp ring 300, guide roll 301, with its mounting appurtenances, inner drive disc 302, inner drive shaft 303, with hollow tow channel 304 and mounting bearings 305, is rotatably mounted concentrically with the aforementioned knife assembly, said camming assembly being rotatably driven through pulley 306, also by variable means, not shown.

It now becomes apparent that if the knife assembly is driven at a faster rotational speed than the camming assembly, the tow band will be clamped in the niche between the levitated endless belt 273, and the knives 267 and cutting of tow into staple will occur, as described in other embodiments. It is also apparent that the linear speed of the tow band will be the difference between the peripheral speed of the knife edges and the peripheral speed of the outside rim of the cam plate 296. The endless belt 273, will flow with the tow, with no sliding frictional motion, as described before. It becomes further apparent that the rotation of inner drive shaft 303, will induce twist into the tow feed and, that the magnitude of said twist can be accurately controlled by adjustment of the variable driving means. Stated simply, any magnitude of twist can be induced into any linear speed of fibrous feed by adjusting the speed of the two variable driving means. No previous apparatus in the art, Beria or otherwise, has had the capability of performing this function.

The ability to induce widely varying, real (not false) twist into a cutting apparatus feed introduces so many new possibilities that it warrants re-exploration of the fiber processing art:

Yarns unevenly wound on beams or tubes can now be cut without tangling, the twist providing a compact feed.

Feed with excessive twist can now have any portion of that twist removed during the cutting process.

Fluffy, open tow can now be cut, since the machine will convert this into a compact feed.

Static electricity which causes a ballooning action in tow feed and necessitates dissipation or wetting, can now be cut without either operation being necessary.

Feed with loops, slack spots, or broken filaments, can now be processed into higher quality, usable staple, the twist providing a snug cinch-up tensioning and straightening of the feed.

Common staple fiber, made into sliver, can now be processed into accurate, short staple, either by feed from storage cans or directly from the producing card, the induced twist giving the sliver tensile strength sufficient to feed the cutting machine, when previously the sliver was to open and weak and simply broke down.

Obviously, since sliver can now be fed by virtue of the induced twist, it can also be drawn (or stretched) to any desired magnitude by this machine, expensive standard drawing equipment previously employed, now being unnecessary.

Uneven winding tension on beamed yarns has left much of this huge quantity of fiber unprocessable due to the slack ends tangling and breaking down. Twist of feed from beams can now be set to give even tension on all ends and formerly unusable beams may be cut into staple at high rates of production, thus making a quality product from previously unusable fiber.

Figure 17:
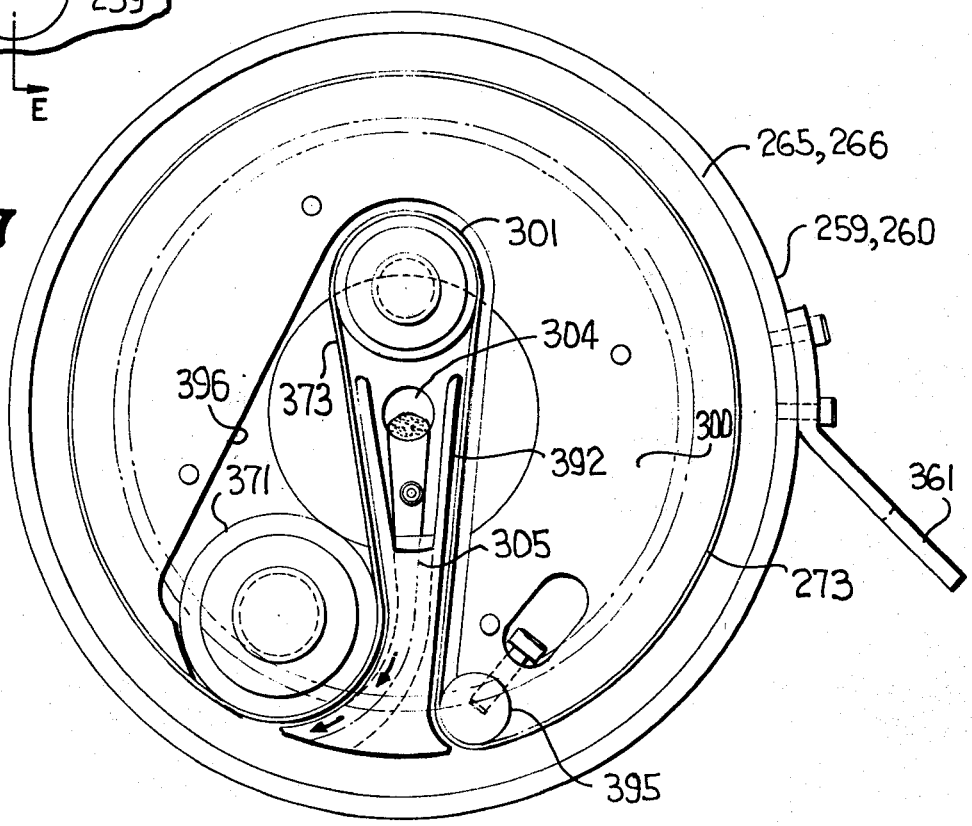
FIG. 17 is an end view of FIG. 16 taken along line E—E showing the tow band path, guides therefor, the endless belt for carrying the tow and rollers for supporting and tensioning the endless belt where it is not necessarily levitated by the air, gas or liquid film, and may require separate driving means.

FIG. 17 further clarifies the embodiment described in FIG. 16. Various parts are shown in their proper configuration as viewed from the end of the assembly opposite the drive ends of the driven concentric shafts. In evidence, in superimposition, are knife support rings 259, 260, attached to knife retaining rings 265, 266, which serve identical functions in this assembly, as in previous embodiments. Both sets of rings are secured in assembly by connector brackets 361. It will be noted that connector brackets 361, in this embodiment are slanted and serve quadruple functions. In addition to securing the two assemblies together, the sloping faces are designed to enhance the exit of cut staple, to fan out and open up the staple for ease in subsequent processing steps, and with the employing of a suitable collector case to convey the cut staple to a central collecting bin or baler.

The camming assembly, rotatable in this embodiment, is shown composed of a cutout plate 396, levitating belt 373, with its carriers, rollers 371 and 301 and rounded shoe 395. Also shown in their proper relationships are tow channel 304, tow guide 392 and the tow band itself. Though not shown, it is to be fully understood that this assembly can process a plurality of tows. It is equally obvious that, since it rotates, it must have dynamic balance to avoid vibration, and the media for levitating the endless belt must be introduced through a rotating pressure coupling, or other means well known in the art.

Though not specifically explained, it is understood in this embodiment that the rotating knife assembly and the rotating camming assembly, being concentrically mounted and caged, may both be driven in the same or in opposite directions. Also it is evident that driving the assemblies in opposite directions produces a greater magnitude of linear speed differential, thus making it practical to process feed at a high linear velocity at lower assembly rotational speeds, thereby avoiding excessive noise, balancing and vibrational problems attendant with most high volume fiber cutting apparatus.

With the above arrangement the expulsion of the cut staple, regardless of length, is certain. The two forces, pressure from the inside and centrifugal force of rotation insures that it will be pushed and flung outward. It will also avoid entanglement, and especially roping, which is common and extremely objectionable in cutting apparatus with a rotating center outlet. Such output of knotted, twisted hanks of staple is almost impossible to process further, particularly if the staple is six inches or more in length.

The principle of centrifugal force, applied alone, provides the concept of an entirely new method of cutting fiber. The cam surfaces, rotating center shaft and assembly, belt and all other parts can be eliminated from the machine leaving simply a hollow shaft, disc, two knife rings and an array of knives. The tow enters through the hollow shaft, proceeds radially by centrifugal force in the manner of the pot spinning process, collects upon the sharp edges of the knife assembly until a pressure (from centrifugal force) builds to cutting magnitude. The fiber cuts and escapes between the knives. More fiber collects, pressure builds, cutting occurs. A wet tow band, much heavier, could be cut with lesser speed and hence less centrifugal force.

From the preceding description of the apparatus it is apparent that there are many arrangements for a tow cutting machine which will operate in accordance with the general principles set forth. The variations of tow cutting apparatus that can be fabricated by combinations of the various embodiments described are almost unlimited. Therefore, the scope of the appended claims should not be limited to the specific embodiments disclosed by way of explanation in this specification.

What I claim as a new and useful contribution to the art and desire to protect by letters patent is:

1. An apparatus for cutting staple fibers, comprising:

A rotatable cam assembly, including a first rotatable shaft, an axial bore in said first rotatable shaft dimensioned to allow passage of a tow there thru, a disc affixed to one end of said first rotatable shaft, a bore centrally positioned in said disc and aligned with said bore of said first rotatable shaft, a plurality of idler rollers axially aligned with said first rotatable shaft and mounted on said disc, and endless belt supported by said plurality of idler rollers, and means for guiding a tow exiting said shaft and disc bores into traction contact with said endless belt; and a rotatable knife assembly, including a second rotatable shaft, an axial bore in said second rotatable shaft dimensioned to permit passage there thru of said first rotatable shaft, a knife support means rigidly affixed to one end of said second shaft perpendicular to the axis thereof and dimensioned to encompass said rotatable cam assembly thereof, and a knife supported by said knife support means and positioned thereby for cutting engagement with a tow at said traction contact with said endless belt.

2. An apparatus as defined in claim 1 wherein said rotatable cam assembly and said rotatable knife assembly are adapted to rotate at different angular velocities.

3. An apparatus as defined in claim 2, further comprising: a shroud means at least partially enclosing said rotatable knife assembly for collecting and conveying said severed tow.

4. An apparatus as defined in claim 3, wherein said rotatable knife assembly knife support means comprises:

a first support ring rigidly affixed to said second rotatable shaft;

a second support ring;

a plurality of bracket means for rigidly securing said second support ring to said first support ring; and first and second knife support rings rigidly affixed to said first and second support rings and positioned to rigidly hold said knife and form a tow channel about said disc wherein said first and second knife support rings form sidewalls for said channel and said knife is positioned in the bottom of said channel.

5. An apparatus as defined in claim 4, wherein said knife includes a plurality of knives spaced about the circumference of said first and second knife support rings.

6. An apparatus as defined in claim 5, wherein at least one of said idler rollers is positioned on said disc and dimensioned such that a portion of the perifery thereof is within said tow channel and said endless belt passes between said idler roller and said knives forming a camming surface therebetween said camming surface adapted to initially pull said tow into partial cutting engagement with said knives and subsequently into severing engagement with said knives.

7. An apparatus as defined in claim 6, further comprising: a first drive means adapted to rotate said first rotatable shaft; and a second drive means adapted to rotate said second rotatable shaft.

8. An apparatus as defined in claim 7, wherein said first and second drive means are adapted to impart controlled differential angular velocities to said first and second rotatable shafts for controlling the velocity of said tow through said bore of said first rotatable shaft and for controllably twisting said tow.

* * * * *